US006241494B1

(12) United States Patent
Pafitis et al.

(10) Patent No.: US 6,241,494 B1
(45) Date of Patent: Jun. 5, 2001

(54) NON-ELASTOMERIC STATOR AND DOWNHOLE DRILLING MOTORS INCORPORATING SAME

(75) Inventors: Demosthenis G. Pafitis, Houston; Vernon E. Koval, Rosenberg, both of TX (US)

(73) Assignee: Schlumberger Technology Company, Sugar Land, TX (US)

( * ) Notice: Subject to any disclaimer, the term of this patent is extended or adjusted under 35 U.S.C. 154(b) by 0 days.

(21) Appl. No.: 09/157,278

(22) Filed: Sep. 18, 1998

(51) Int. Cl.[7] ..... F01C 1/10

(52) U.S. Cl. ..... 418/48; 418/179; 175/107; 29/888.023

(58) Field of Search ..... 418/48, 179, 153, 418/11; 29/888.023; 175/107

(56) References Cited

U.S. PATENT DOCUMENTS

| | | | | |
|---|---|---|---|---|
| 2,527,673 | | 10/1950 | Byram . | |
| 3,840,080 | * | 10/1974 | Berryman | 175/107 |
| 3,975,121 | | 8/1976 | Tschirky . | |
| 4,764,094 | * | 8/1988 | Baldenko et al. | 418/5 |
| 4,909,337 | * | 3/1990 | Kochnev et al. | 175/107 |
| 5,171,138 | | 12/1992 | Forrest . | |
| 5,221,197 | * | 6/1993 | Kochnev et al. | 418/48 |
| 5,439,359 | | 8/1995 | Leroy et al. . | |
| 5,755,023 | | 5/1998 | Neuenschwander . | |
| 5,759,019 | | 6/1998 | Wood et al. . | |
| 5,785,509 | * | 7/1998 | Harris et al. | 418/11 |
| 5,832,604 | * | 11/1998 | Johnson et al. | 29/888.023 |

FOREIGN PATENT DOCUMENTS

| | | | | |
|---|---|---|---|---|
| 0003676 | * | 8/1979 | (EP) | 418/48 |
| 2 084 697 | * | 4/1982 | (GB) | 418/48 |

* cited by examiner

*Primary Examiner*—Thomas Denion
*Assistant Examiner*—Thai Ba Trieu
(74) *Attorney, Agent, or Firm*—Steven L. Christian

(57) ABSTRACT

A drilling motor includes a non-elastomeric stator and rotor which are dimensioned for negative or zero interference. The amount of negative interference between the rotor and the stator is determined by the largest solid particle expected to pass through the motor. The negative interference or gap between the rotor and the stator is preferably at least two times the greatest particle size. According to the invention, stators are made by machining or casting stainless steel and are fabricated in sections having lengths of 20 to 40 centimeters. The sections are indexed so that each section may be properly aligned with another. The sections are aligned and welded together to form a motor stator of conventional length.

7 Claims, 4 Drawing Sheets

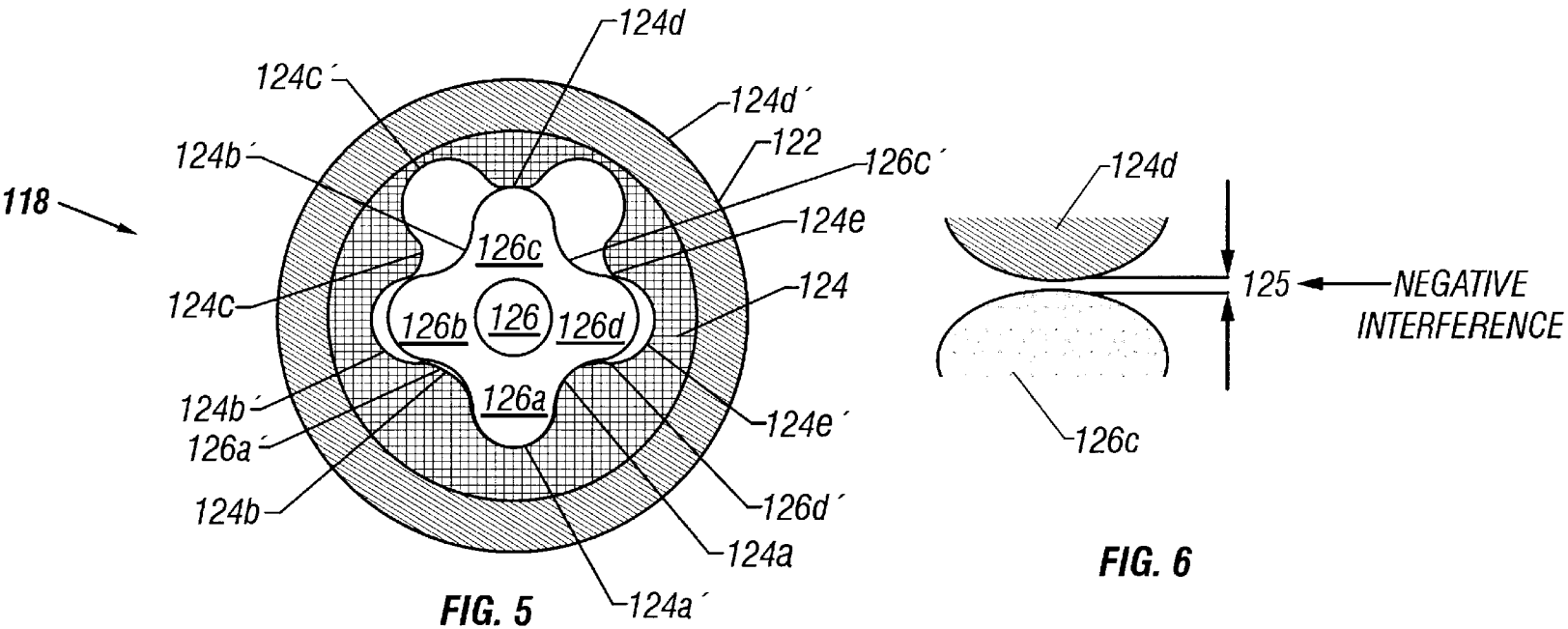
FIG. 5
(Prior Art)
FIG. 6
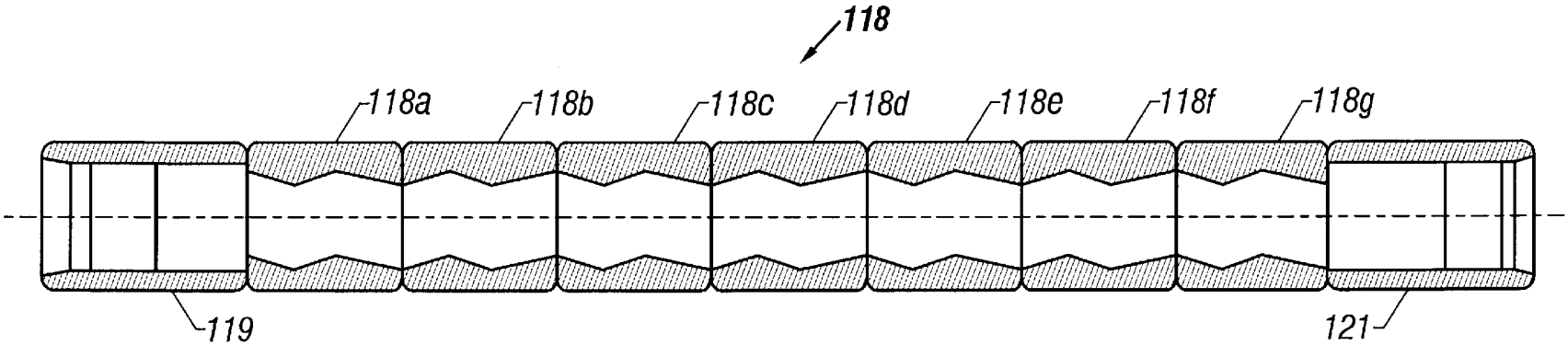
FIG. 7

NON-ELASTOMERIC STATOR AND DOWNHOLE DRILLING MOTORS INCORPORATING SAME

BACKGROUND OF THE INVENTION

1. Field of the Invention

The invention relates to mud driven motors used in the drilling of oil wells. More particularly, the invention relates to a downhole drilling motor which has a wholly non-elastomeric stator and rotor.

2. Description of the Related Art

The idea of downhole motors for driving an oil well drill bit is more than one hundred years old. Modern downhole motors are powered by circulating drilling fluid (mud) which also acts as a lubricant and coolant for the drill bit. Prior art FIG. 1 shows a state-of-the-art downhole motor assembly. The assembly 10 generally includes a rotatable drill bit 12, a bearing/stabilizer section 14, a transmission section 16 which may include an adjustable bent housing (for directional drilling), a motor power section 18, and a motor dump valve 20. The bent housing 16 and the dump valve 20 are not essential parts of the downhole motor. As mentioned above, the bent housing is only used in directional drilling. The dump valve is used to allow drilling fluid to enter the motor as it is lowered into the borehole and to allow drilling fluid to exit the motor when it is pulled out of the borehole. The dump valve also shuts the motor off when the drilling fluid flow rate drops below a threshold. During operation, drilling fluid pumped through the drill string (not shown) from the drilling rig at the earth's surface enters through the dump valve 20, passes through the motor power section 18 and exits the assembly 10 through the drill bit 12.

Prior art FIGS. 2 and 3 show details of the power section 18 of the downhole motor. The power section 18 generally includes a housing 22 which houses a motor stator 24 within which a motor rotor 26 is rotationally mounted. The power section 18 converts hydraulic energy into rotational energy by reverse application of the Moineau pump principle. The stator 24 has a plurality of helical lobes, 24*a*–24*e*, which define a corresponding number of helical cavities, 24*a*'–24*e*'. The rotor 26 has a plurality of lobes, 26*a*–26*d*, which number one fewer than the stator lobes and which define a corresponding plurality of helical cavities 26*a*'–26*d*'. Generally, the greater the number of lobes on the rotor and stator, the greater the torque generated by the motor. Fewer lobes will generate less torque but will permit the rotor to rotate at a higher speed. The torque output by the motor is also dependent on the number of "stages" of the motor, a "stage" being one complete spiral of the stator helix.

In state-of-the-art motors, the stator 24 is made of an elastomeric lining which is molded into the bore of the housing 22. The rotor and stator are usually dimensioned to form a positive interference fit under expected operating conditions, as shown at 25 in prior art FIG. 4. The rotor 26 and stator 24 thereby form continuous seals along their matching contact points which define a number of progressive helical cavities. When drilling fluid (mud) is forced through these cavities, it causes the rotor 26 to rotate relative to the stator 24. The interference fit 25 is defined by the difference between the mean diameter of the rotor 26 and the minor diameter of the stator 24 (diameter of a circle inscribed by the stator lobe peaks). Motors which have a positive interference fit of more than about 0.559 millimeters (0.022 inches) are very strong (capable of producing large pressure drops) under downhole conditions. However, a large positive interference fit will provoke an early motor failure. This failure mode is referred to as "chunking".

Interference fit is believed to be critical to the performance and overall life of the motor. In practice, the magnitude of the interference fit (at the time of assembly) is dictated by the expected temperature of the drilling fluid and downhole pressure. High temperatures will cause the elastomeric stator of a motor with negative or zero interference fit to expand and form a positive interference fit. For use at lower temperatures, it is necessary to assemble the motor with a positive interference fit. As mentioned above, a motor with excessive interference fit will fail early. On the other hand, a motor with insufficient interference fit will be a weak motor which stalls at relatively low differential pressure. A motor stalls when the torque required to turn the drill bit is greater than the torque produced by the motor. When this happens, mud is pumped across the seal faces between the rotor and the stator. The lobe profile of the stator must then deform for the fluid to pass across the seal faces. This results in very high fluid velocity across the deformed stator lobes.

In addition to temperature, certain types of drilling fluids may have an adverse effect on the operation of the drilling motor. For example, certain types of oil-based drilling fluid and drilling fluid additives can cause elastomeric stators to swell and become weak. Therefore, the composition of the drilling fluid must also be considered when choosing a motor with the appropriate amount of interference fit.

Those skilled in the art will appreciate that the elastomeric stator of drilling motors is a vulnerable component and is responsible for many motor failures. However, it is generally accepted that either or both the rotor and stator must be made compliant in order to form a hydraulic seal. As mentioned above, it is generally believed that without sufficient positive interference (hydraulic seal) between the rotor and stator, the motor will be weak (generate low torque) and will easily stall.

SUMMARY OF THE INVENTION

It is therefore an object of the invention to provide a drilling motor power section which has no elastomeric parts.

It is also an object of the invention to provide a drilling motor which is virtually immune to chunking.

It is another object of the invention to provide a drilling motor which is operable throughout a wide range of temperatures without adversely affecting the integrity of the stator.

In accord with these objects which will be discussed in detail below, the drilling motor of the present invention includes a non-elastomeric stator and a rotor which are dimensioned for negative interference. The rotor and stator are preferably metallic and made of a thermally and chemically stable metal such as stainless steel. It will be recognized that other non-elastomeric materials, such as ceramics and composites, may also be employed. When a non-elastomeric stator is used, the difference between the outer diameter of the housing (or the stator if no housing is used) and the maximum diameter of the stator profile can be decreased significantly without reducing the stiffness of the stator. A smaller difference in these diameters allows the motor to produce higher torque. According to a preferred embodiment, the amount of negative interference between the rotor and the stator is determined by the largest solid particle expected to pass through the motor. The gap between the rotor and the stator is preferably at least two times the greatest particle size. According to the invention, metallic stators are made by machining or casting. Due to the size limitations imposed by both fabrication techniques, stators according to the invention are fabricated in sections having lengths of 20 to 40 centimeters (8 to 16 inches). The sections are indexed so that each section may be properly aligned with another. The sections are aligned and welded together to form a motor stator of conventional length.

Additional objects and advantages of the invention will become apparent to those skilled in the art upon reference to the detailed description taken in conjunction with the provided figures.

BRIEF DESCRIPTION OF THE DRAWINGS

FIG. 5 is a view similar to FIG. 3, but of a motor according to the invention;

FIG. 6 is an enlarged view of a portion of FIG. 5 where the rotor and stator interface;

FIG. 7 is a longitudinal sectional view of a stator according to the invention.

DESCRIPTION OF THE PREFERRED EMBODIMENTS

Figure 1:
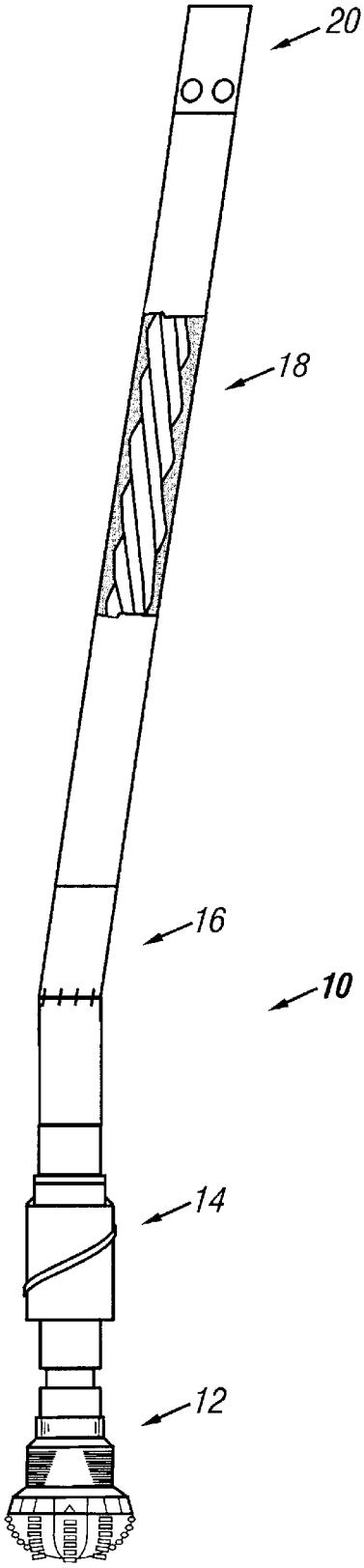
FIG. 1 (Prior Art)
FIG. 1 is a side elevation view of a prior art drilling motor assembly.
Figure 2:
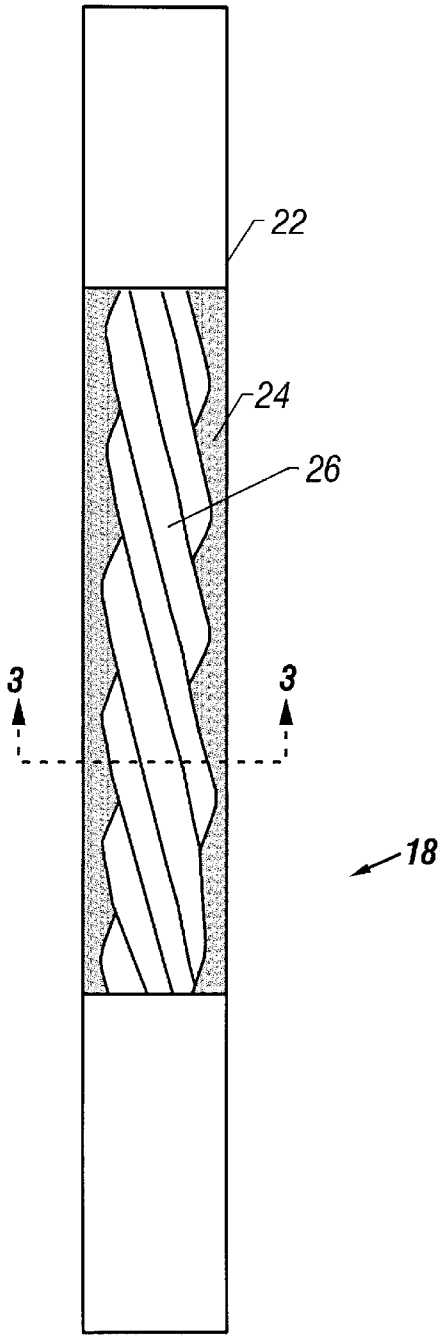
FIG. 2 (Prior Art)
FIG. 2 is a cutaway view of the motor of FIG. 1 showing the rotor and the stator.
Figure 4:
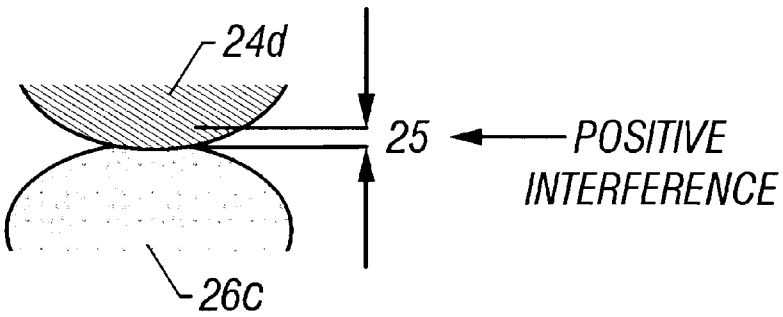
FIG. 4 (Prior Art)
FIG. 4 is an enlarged view of a portion of FIG. 3 where the rotor and stator interface.
Figure 3:
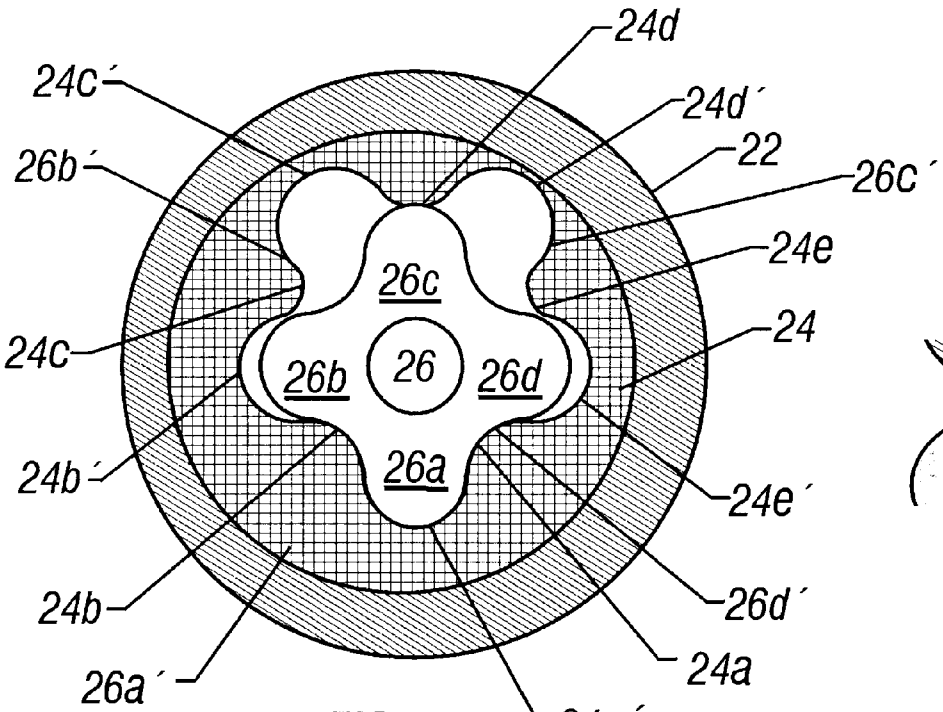
FIG. 3 (Prior Art)
FIG. 3 is a cross section taken along the line 3—3 in FIG. 2.

As shown in FIG. 5, a motor according to the invention includes a power section 118. The power section generally includes a housing 122 which houses a non-elastomeric motor stator 124 within which a rotor 126 is rotationally mounted. The stator 124, which is preferably formed from stainless steel, has a plurality of helical lobes, 124*a*–124*e*, which define a corresponding number of helical cavities or grooves, 124*a*'–124*e*'. The rotor 126, which is preferably also formed from stainless steel, has a plurality of lobes, 126*a*–126*d*, which number one fewer than the stator lobes and which define a corresponding plurality of helical cavities or grooves 126*a*'–126*d*'. According to the invention, as shown in FIG. 6, the relative dimensions of the stator and rotor are chosen to provide a negative interference fit with a gap 125 between the stator lobes and the rotor lobes, for example 124*d* and 126*c*. According to a preferred embodiment of the invention, the amount of negative interference between the rotor 126 and the stator 124 is determined by the largest solid particle expected to pass through the motor. The negative interference or gap 125 between the rotor 126 and the stator 124 is preferably at least two times the greatest particle size. However, it will be recognized that a motor according to the present invention may also be designed with zero interference fit.

With the stator 124 of the invention, the difference between the outer diameter of the housing (or the stator if no housing is used) and the maximum diameter of the stator profile can be decreased significantly without reducing the stiffness of the stator. A smaller difference in these diameters allows the motor to produce higher torque.

Due to the size limitations imposed by machining and casting techniques, stators according to the invention are fabricated in sections having lengths of 20 to 40 cm (8 to 16 inches). For example, as shown in FIG. 7, the power section 118 of a drilling motor according to the present invention is made from a plurality of sections 118*a*–118*g*. The sections are indexed so that each section may be properly aligned with another. After the sections are fabricated and indexed, the sections are aligned and welded together to form a motor stator of conventional length. According to a preferred embodiment of the invention, end pieces 119 and 121 are welded to the assembly. The end pieces 119, 121 provide suitable threaded connection to a conventional motor bearing and transmission assembly and other drill string components such as dump valves.

According to the invention, non-elastomeric stators are made by machining or casting. For example, a metallic stator was fabricated by machining eight individual sections, each having a length of approximately 20 cm (8 inches) and a diameter of approximately 17 cm (6.75 inches). Each section was indexed to produce a continuous internal lobe profile. The sections were electron beam welded to each other around their outer circumferences. The stator had five lobes and 2.1 stages. Two rotors were tested with the stator. In one case, the gap between the rotor and stator was approximately 0.330±0.127 mm (0.013±0.005 inches) at standard temperature and pressure. In the other case, the gap between the rotor and stator was approximately 0.584±0.127 mm (0.023±0.005 inches) at standard temperature and pressure.

Figure 8:
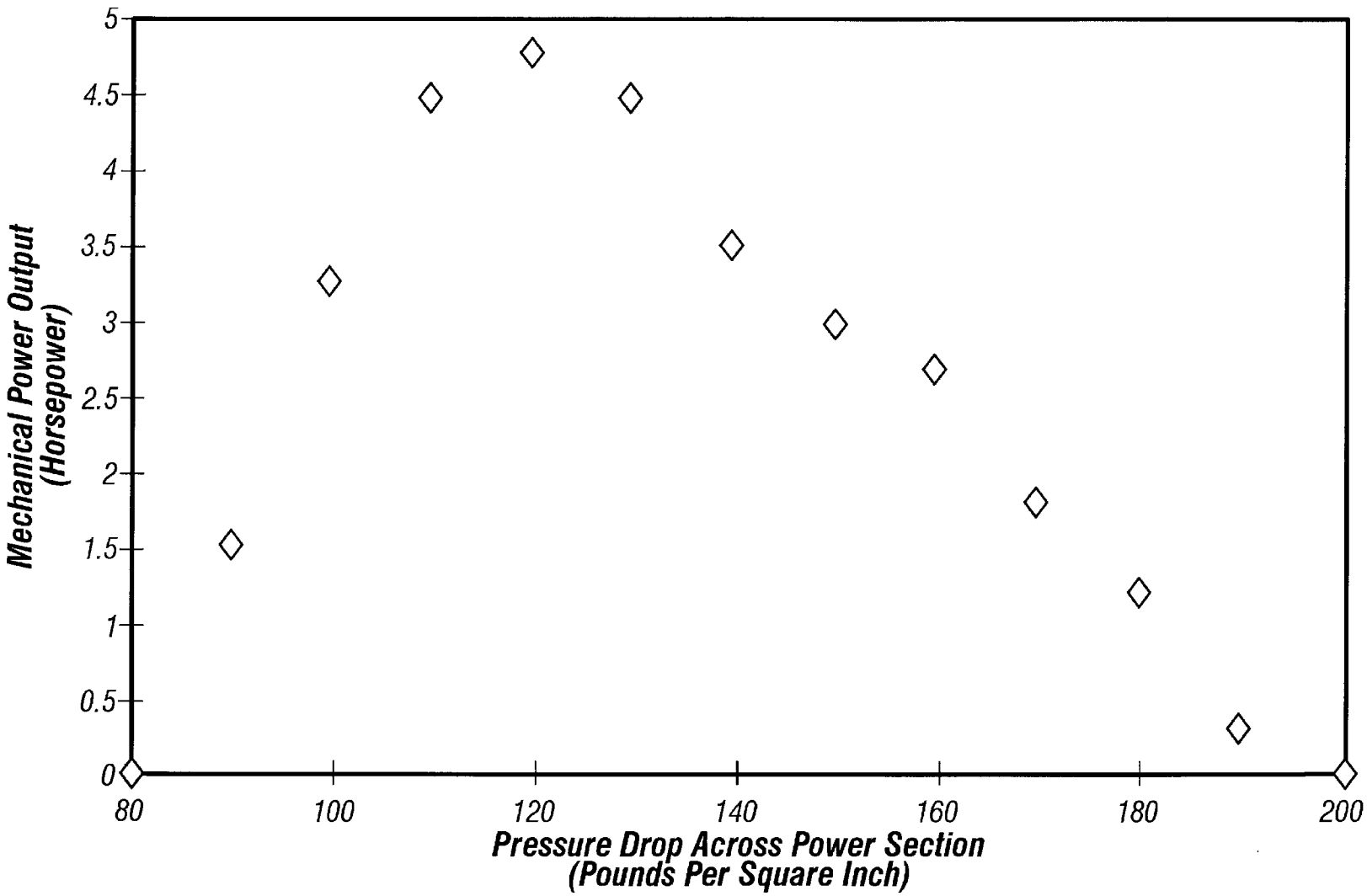
FIG. 8 is a plot of mechanical power output as a function of pressure drop across the power section in a motor according to the invention.

The performance of the motors was tested on a dynamometer using water as the energizing fluid over a range of flow rates. An example of the data produced from the tests is shown in FIG. 8 where the mechanical power output of the test motor is plotted against pressure drop across the power section.

There have been described and illustrated herein a downhole drilling motor incorporating a non-elastomeric stator. While a particular embodiment of the invention has been described, it is not intended that the invention be limited thereto, as it is intended that the invention be as broad in scope as the art will allow and that the specification be read likewise. Thus, while particular dimensions have been disclosed, it will be appreciated that other dimensions could be utilized to obtain a negative or zero interference fit. Also, while a particular number of lobes and stages have been shown, it will be recognized that other numbers of lobes and stages could be used with similar results obtained. It will therefore be appreciated by those skilled in the art that yet other modifications could be made to the provided invention without deviating from its spirit and scope as so claimed.

We claim:

1. A downhole drilling motor for use in a drillstring disposed in a subsurface wellbore, comprising:

a) a non-elastomeric stator having a first plurality of helical lobes; and b) a non-elastomeric rotor having a second plurality of helical lobes, said rotor being rotationally disposed within said stator, wherein said rotor and said stator are dimensioned relative to each other for a negative interference fit or zero interference fit; and said stator includes a plurality of sections connected in end-to-end fashion substantially independently of a supplemental connector.

2. A motor according to claim 1, wherein:

said stator and said rotor are metallic.

3. A motor according to claim 1, wherein:

said stator is comprised of a plurality of machined stainless steel sections welded together in end-to-end fashion.

4. A motor according to claim 1, wherein:

said stator is comprised of a plurality of cast stainless steel sections welded together in end-to-end fashion.

5. A motor according to claim 1, further comprising:

c) a drill bit; and d) a bearing assembly, said drill bit being coupled to said rotor by said bearing assembly.

6. A motor according to claim 5, further comprising:

e) a transmission assembly, said drill bit being coupled to said rotor by said bearing assembly and said transmission assembly.

7. A motor according to claim 6, further comprising:

f) a dump valve coupled to said motor for regulating the flow of drilling fluid between said rotor and said stator.

* * * * *